United States Patent [19]
Theurer
[11] 4,227,324
[45] Oct. 14, 1980

[54] MOBILE APPARATUS FOR DISTRIBUTING AND SHAPING BALLAST OF A RAILROAD BED

[75] Inventor: Josef Theurer, Vienna, Austria

[73] Assignee: Franz Plasser Bahnbaumaschinen-Industriegesellschaft m.b.H., Vienna, Austria

[21] Appl. No.: 9,592

[22] Filed: Feb. 5, 1979

[30] Foreign Application Priority Data

Apr. 28, 1978 [AT] Austria ..... 3180/78

[51] Int. Cl.³ ..... E02F 5/22
[52] U.S. Cl. ..... 37/104; 104/279; 37/30
[58] Field of Search ..... 37/104, 105, 30, 32–34, 37/44, 46; 172/782; 104/279

[56] References Cited

U.S. PATENT DOCUMENTS

| | | | |
|---|---|---|---|
| 2,840,930 | 7/1958 | Mundell et al. | 37/104 |
| 3,468,042 | 9/1969 | Coy | 37/104 |
| 3,491,467 | 1/1970 | Finger | 37/104 |
| 3,605,297 | 9/1971 | Kershaw | 37/105 |
| 3,624,936 | 12/1971 | Yard | 37/104 |
| 3,877,160 | 4/1975 | Plasser et al. | 37/104 |
| 4,108,076 | 8/1978 | Knape | 37/104 |

*Primary Examiner*—Eugene H. Eickholt
*Attorney, Agent, or Firm*—Kurt Kelman

[57] ABSTRACT

A mobile ballast plow comprises a plow arrangement vertically adjustably mounted on a frame and including a V-shaped central plow consisting of two plow blades rigidly interconnected at an apex of the central plow, a side plow associated with each one of the track rails, each of the side plows having a single ballast guide blade adjustably between the track rails and having an effective operating length extending to the apex of the central plow, and a tunnel-shaped element extending over and covering each track rail.

7 Claims, 7 Drawing Figures

MOBILE APPARATUS FOR DISTRIBUTING AND SHAPING BALLAST OF A RAILROAD BED

The present invention relates to a mobile apparatus for distributing and shaping ballast of a railroad bed whereon there are supported two track rails.

U.S. Pat. No. 3,877,160, dated Apr. 15, 1975, discloses such an apparatus wherein two undercarriages mount a machine frame on the track trails for mobility thereon and a ballast plow arrangement is mounted on the frame between the undercarriages. The plow arrangement includes three plow blades pivotal about a common, centrally positioned vertical pivot axis, two of the plow blades being positionable symmetrically with respect to a center line extending between the track rails so as to form a substantially V-shaped central plow having an apex. Ballast in front of the apex or pushed towards it by side plow blades from the side-banks of the railroad bed can be guided along one or both of the blades of the central plow for distributing in the region of the respective side-banks by suitably pivoting the third plow blades which is pivotal about the apex of the central plow. This apparatus, which is also equipped with a mechanism for receiving and conveying excess ballast as well as a large ballast silo for storing the excess ballast, has enjoyed considerable commercial success because of its great efficiency and savings in ballast.

U.S. Pat. No. 3,605,297, dated Sept. 20, 1971, deals with a railroad ballast plow mounted on a vehicle which exchangeably runs of road wheels or rail wheels. Its plow arrangement consists of a central plow extending from the front of the vehicle frame and two pivotal side plow blades effective in the sidebanks of the railroad bed. The central plow is mounted on a support frame which may be upwardly pivoted by cables about a transverse horizontal axis and has two like plow blades slightly spaced from each other in the longitudinal direction of the machine. Each plow blade of the central plow consists of two blade halves pivotal about a common, central vertical pivot axis. Each half has a cut-out portion in position to receive one of the rails when the blade halves are in either of their operating positions. The plow blades at the same side of the machine are interconnected by links to form a parallelogram motion mechanism. In view of the geometric conditions, only two pivotal positions of the plow blades are possible, in which a respective rail passes centrally through the cut-outs. Thus, in addition to adjusting the plow blades as a V-shaped central plow pointing either frontwardly or rearwardly, only two other positions can be arranged, in which the plow blades on both sides of the machine form a continuous plowing face extending obliquely across the track. This plow arrangement has many disadvantages. The considerable forces exerted upon the plow blades particularly by large amounts of plowed ballast must be absorbed primarily by the pivots of the blade halves, causing these pivots to be worn out rapidly. Compared to the considerable complexity of the pivoting structure and drives for the plow blades, the operative positions of the central plow are relatively limited. There is no possibility, for example, to adjust the amount of ballast to be distributed from the center of the track to the side-banks in any desired manner. Even more disadvantageous is the fact that the ballast is moved at the points of intersection between the plow blades and the rails directly over the unprotected rails and the rail fastening elements. This may seriously damage these track parts. It may also lead to jamming of individual ballast pieces between rail fastening elements and the edge of the cut-outs as the plow blades move in the track direction. This will unavoidably damage not only the track but also the plow blades.

It is the primary object of this invention to provide a mobile apparatus for distributing and shaping ballast of a railroad bed which has a simple and robust structure while being highly adaptable to various operating conditions.

This and other objections are accomplished in accordance with the invention with a ballast plow arrangement vertically adjustably mounted on a machine frame and including a V-shaped central plow consisting of two plow blades rigidly interconnected at an apex of the central plow, a side plow associated with each one of the track rails, each one of the side plows having a single ballast guide blade adjustable between the track rails and having an effective operating length extending to the apex of the central plow, and a tunnel-shaped element extending over and covering each one of the track rails.

In this plow arrangement, the number of the ballast guide blades movable to produce any desired distribution and shaping of the ballast has been reduced to two, thus also requiring only two blade drives, which not only greatly reduces manufacturing costs and the machine weight but also results in reduced wear on the plow parts and less maintenance. Despite this greatly simplified structure, the machine fully meets all operating and efficiency requirements for universally useful ballast plows. The free adjustability of the two guide blades cooperating with the central plow enables the apparatus not only to distribute ballast stored in the center of the track or at the side-banks towards one or both side-banks but also to adjust the amount of the ballast flowing along the two blades of the rigid central plow individually so that the ballast may be distributed in any desired manner along the side-banks of the bed. Finally, passage of ballast through the plow arrangement may be temporarily stopped completely by adjusting the position of both guide blades so that their ends adjoin the apex of the central plow. This is important, for example, when there is a paucity of ballast between the rails in a section of the track over which the apparatus passes. In this case, the cribs containing an insufficient amount of ballast are at least partially filled with ballast stowed in front of the closed plow arrangement.

Furthermore, the rigid construction of the central plow and the relatively low stress to which the pivotal guide blades are subjected due to the fact that they operate primarily as ballast guides rather than plow blades make it possible in some cases to increase the height of the plow faces without making the plow blades stronger, which may be quite desirable. Such higher plow blades largely avoid jamming and subsequent stopping of the plow where the stowed amounts of ballast in front of the plow are considerable.

The adjustment of the guide blades may be effected by a pivotal movement of the guide blades as well as a reciprocatory movement thereof.

The above and other objects, advantages and features of the present invention will become more apparent from the following detailed description of certain now preferred embodiments thereof, taken in conjunction with the accompanying schematic drawing wherein FIG. 1 is a side elevational view of one embodiment of a mobile ballast distributing and shaping apparatus according to this invention;

Figure 4:
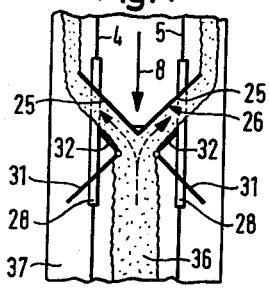
Figure 5:
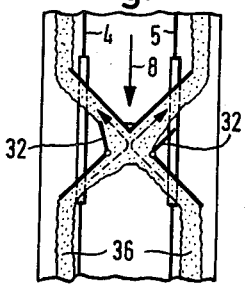
Figure 6:
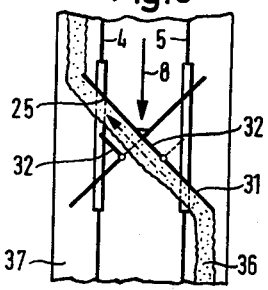
Figure 7:
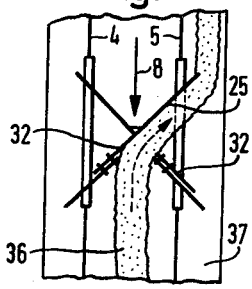

FIGS. 4 to 6 diagrammatically show different operating positions of the guide blades of the plow arrangements; and FIG. 7 is a diagrammatic top view of yet another embodiment wherein the guide blades are slidably adjustable.

Figure 1:
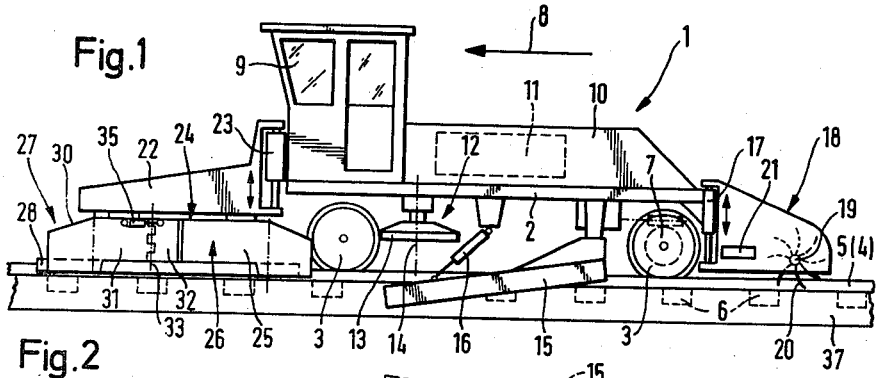
Figure 2:
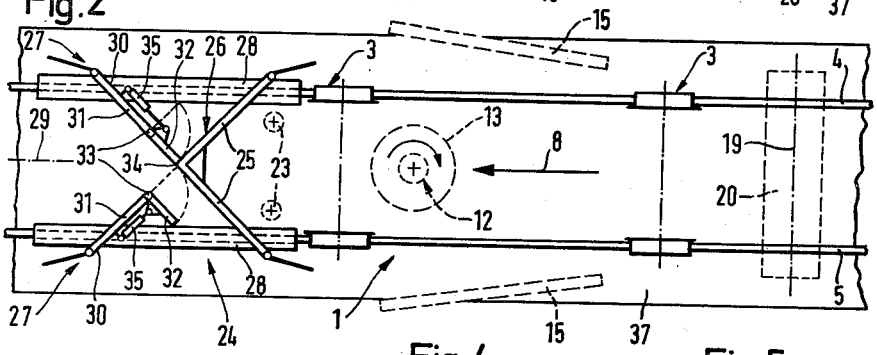
FIG. 2 is a top view of the plow arrangement shown in FIG. 1.

Referring now to the drawing and first to FIGS. 1 and 2, there is shown mobile apparatus 1 for distributing and shaping ballast of a railroad bed whereon there are supported two track rails 4, 5 fastened to ties 6. Apparatus 1 has frame 2 mounted on undercarriages 3 for mobility on the track rails in an operating direction indicated by arrow 8. The illustrated apparatus is self-propelled and has a drive 7 transmitting power to the wheels of rear undercarriage 3. Operator's cab 9 is mounted on the front end of frame 2 and holds a control panel for operating the apparatus. Housing 10 mounted on the frame rearwardly of cab 9 contains power plant 11 from which power is supplied to drive 7 as well as all the drives operating movable parts of the apparatus.

The illustrated apparatus also comprises a centrally positioned means for raising frame 2 and for turning its 180° with respect to track rails 4, 5 which is constituted by turntable 12 mounted on the frame substantially in the range of the point of gravity of the apparatus. This turntable comprises a support plate or shoe 13 which may be lowered into engagement with the ballast between the track rails by a hydraulic jack. In this manner, apparatus 1 may be lifted at any desired location above the track and, to change the operating direction, may be turned 180° about vertical axis 14. Thus, the machine may be turned around at any selected place without interruption of the operation for any substantial length of time.

Apparatus 1 is also equipped with side-bank plows 15 laterally pivotally mounted on each side of frame 2, their angular position being adjustable by hydraulic drives 16 connecting ballast plows 15 to the frame.

Ballast broom implement 18 is vertically adjustably mounted on the rear of frame 2 and may be lifted and lowered along guide rods supporting the implement housing on the frame by hydraulic drives 17. Rotary broom 20 is journaled in the implement housing for rotation about horizontal transverse axis 19 and extends over the entire width of the ballast bed, the housing defining outlet openings 21 for discharging excess ballast swept up by the rotary broom.

In the embodiment of FIGS. 1 and 2, overhanging support frame 22 is vertically adjustably mounted on the front end of frame 2 and may be lifted and lowered along guide rods supporting the support frame on frame 2 by hydraulic drives 23. Ballast plow arrangement 24 is mounted on the underside of support frame 22. The common vertical drive for all parts of the plow arrangement simplifies the entire structure, reduces the manufacturing costs and the weight of the machine and facilitates maintenance and servicing of the machine.

As best shown in FIG. 2, the plow arrangement according to the invention includes V-shaped central plow 26 consisting of two plow blades 25 rigidly interconnected at apex or tip 34 of the central plow. A side plow 27 is associated with each track rail 4 and 5. Each side plow has a single ballast guide blade 32 adjustable between the track rails and having an effective operating length extending to apex 34 of central plow 26. A tunnelshaped element 28 extends over and covers each track rail to protect the rails and the rail fastening elements against damage from ballast conveyed by plow arrangement 24 and to facilitate the ballast conveyance over the rails to the side-banks of the railroad bed. The tunnel-shaped elements extend over the rails at least for the length of the operating range of the plow arrangement.

The two plow blades 25 of central plow 26 are rigidly connected to support frame 22 as well as to tunnel-shaped cover elements 28.

Each side plow 27 includes a blade portion 31 arranged fixedly in relation to tunnel-shaped element 28 extending over the track rail with which the side plow is associated and in the embodiment of FIGS. 1 and 2, a vertical pivot 33 mounts each guide blade 32 on blade portion 31 whereby the guide blades adjoin the fixed blade portions. Guide blades 32 are arranged symmetrically with respect to center line 29 extending between track rails 4 and 5, and blade portions 31 are affixed rigidly to tunnel-shaped elements 28 as well as support frame 22. The fixed blade portions 31 and adjustable guide blades 32 constitute side plow blades 30 extending obliquely in a transverse direction with respect to the rails. As indicated in broken lines in FIG. 2, pivot 33 is arranged substantially centrally between apex 34 of central plow 26 and tunnel-shaped element 28, and guide blades 32 are pivotal about the vertical pivot through an angle of about 90°. Hydraulic drive 35 is connected between each guide blade 32 and fixed blade portion 31 pivotally supporting it to enable the guide blade to be pivoted for any selected adjustment, the hydraulic drive holding the guide blade in the adjusted angular position. If desired, the pivoting angle of the guide blades could be increased up to about 270°.

The pivotal adjustment of symmetrically arranged guide blades enables a substantially continuous control of the guide blade adjustment for different widths of ballast passage through the gate defined between the ends of the guide blades and apex 34 of the central plow. These pivotal guide blades serve not only as gates but also to direct the ballast into selected areas.

The pivotal mounting of the guide blades directly on the fixed blade portions of the side plow blades makes it possible to use simple hinges for this purpose. This avoids the use of special pivot pins connecting the guide blades to the support frame for the plow arrangement and further simplifies the construction. When pivoted into alignment with the fixed blade portion, the guide blade forms a side plow blade extending in the same direction as plow blade 25 of the central plow and constituting therewith a continuous plow extending over the entire width of the ballast bed and causing ballast to be moved from one side-bank to the opposite side-bank as the plow arrangement moves along the track.

The pivotal arrangement of the guide blades provides a continuously adjustable gate for ballast to pass through, the gate being adjustable between zero and a full opening so that any desired amount of ballast may be distributed to either one of the side-banks. Since there is a substantial distance between vertical pivots 33, sufficient space is provided for ballast to pass therebetween so that even considerable accumulations of ballast in front of the plow arrangement will not interfere with the operation thereof.

As shown, plow blades 25 of central plow 26 as well as side plow blades 20 may carry wings hinged to the ends thereof. The angular position of these pivotal wings may be suitably adjusted by drives (not shown) to enable the effective width of the plow blades to be changed in accordance with requirements.

Figure 3:
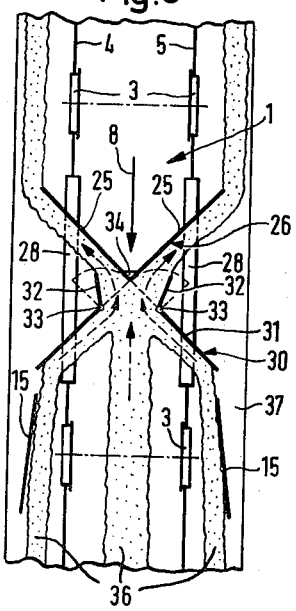
FIG. 3 is a top view showing another embodiment illustrated diagrammatically.

The embodiment of FIG. 3 differs from the above-described embodiment essentially in that plow arrangement 24 is vertically adjustably mounted on frame 2 between undercarriages 3 and, furthermore, side-bank plows 15 are arranged forwardly of the plow arrangement in the operating direction 8.

The operation of the plow arrangement in various operating positions of guide blades 32 is indicated in FIGS. 3 to 6.

In FIG. 3, it is assumed that ballast 36 has been stored in the track section to be surfaced centrally between the track rails and on the side-banks next to the rails on ballast bed 37 in front of the plow. The flow of the ballast, i.e. the movement of the ballast relative to plow arrangement 24, has been indicated on the drawing with arrows in broken lines.

As apparatus 1 advances in operating direction 8, ballast 36 in front of the machine is directed into the effective operating range of central plow 26. As shown, the ballast stored on the side-banks as well as any excess ballast produced by side-banks plows 15 in shaping the side-banks is directed along side plow blades 30 over tunnel-shaped cover elements 28 towards the center of the track where it joins the ballast stored in the center to reach central plow 26. At apex 34 of the central plow, the stowed ballast is divided into two streams flowing along plow blades 25 and over tunnel-shaped cover elements 28 to the two side-banks where it is stored. The angular position of guide blades 32 determines the amount of ballast passing to either side and thus the ballast amount stored on the respective side-banks. The symmetrical adjustment of the guide blades in FIG. 3 assures a substantially even distribution of ballast to both side-banks.

In FIG. 4, guide blades 32 are shown in their fully opened position which enables the ballast 36 stored in the center of the track also to be distributed evenly to both side-banks. Any lateral displacement of the stored ballast may be compensated by a corresponding adjustment of a respective guide blade.

In the operating position shown in FIG. 5, substantially different amounts of ballast 36 are stored on the side-banks in front of the plow arrangement. To assure an even distribution of ballast to the two side-banks by the plow arrangement, guide blade 32 on the right side of the figure is fully opened while the other guide blade is adjusted to an intermediate position so as to restrict the flow of ballast on the side of the machine where more ballast is stored.

FIG. 6 illustrates an operating position wherein ballast stored at one side-bank is distributed to the other side-bank. For this purpose, guide blade 32 appearing on the left side of the figure is pivoted to its fully open position, i.e. enclosing an angle of about 90° with fixed blade portion 31, while the other guide blade is in its fully closed position, i.e. in alignment with the fixed blade portion on which it is pivoted and with its outer end adjoining apex 34 of the central plow. The latter side plow blade 30 and adjoining central plow blade 25 thus form a continuous ballast guide face across the entire width of the ballast bed. The position of the guide blades 32 for moving the ballast from one side-bank to the other in the opposite direction has been indicated in broken lines.

FIG. 7 shows another embodiment of an adjustable guide blade mounting wherein guide blade 32 is slidably mounted on the fixed blade portion for reciprocating movement with respect thereto. The positions of the two guide blades are reversed as compared to those shown in FIG. 6 and the plow arrangement is shown moving stored ballast from the center of the track to one side-bank. The guide blades are mounted in guide rails on the fixed blade portions and are adjustable by hydraulic motors in the same manner as the pivotal guide blades of the first described embodiment.

While not illustrated, both guide blades 32 may be adjusted into their closed positions, i.e. with their outer ends adjoining apex 34 of the central plow, so that no ballast will pass through the plow arrangement and forward movement of apparatus 1 will cause ballast to be stowed in front of the apparatus.

What is claimed is:

1. A mobile apparatus for distributing and shaping ballast of a railroad bed whereon there are supported two track rails, comprising (a) a frame and (b) a ballast plow arrangement vertically adjustably mounted on the frame, the plow arrangement including (1) a V-shaped central plow consisting of two plow blades rigidly interconnected at an apex of the central plow, (2) a side plow associated with each one of the track rails, each one of the side plows having a single ballast guide blade adjustable between the track rails and having an effective operating length extending to the apex of the central plow, and (3) a tunnel-shaped element extending over and covering each one of the track rails.

2. The mobile apparatus of claim 1, wherein the ballast guide blades are arranged symmetrically with respect to a center line extending between the track rails, and further comprising a vertical pivot for each one of the guide blades for adjusting the guide blades.

3. The mobile apparatus of claim 2, wherein each one of the side plows includes a blade portion arranged fixedly in relation to the tunnel-shaped element extending over the track rail with which the side plow is associated, the vertical pivot mounting the guide blade on the fixed blade portion whereby the guide blade adjoins the fixed blade portion.

4. The mobile apparatus of claim 3, wherein the blade portion is affixed to the tunnel-shaped element.

5. The mobile apparatus of claim 3 or 4, wherein the vertical pivot is arranged substantially centrally between the apex of the central plow and the tunnel-shaped element, and the guide blade is pivotal about the vertical pivot through an angle of at least 90°.

6. The mobile apparatus of claim 1, further comprising a common drive connecting the ballast plow arrangement to the frame for vertical adjustment.

7. The mobile apparatus of claim 1, further comprising a centrally positioned means for raising the frame and for turning it 180° with respect to the track rails.

* * * * *